US005697316A

United States Patent [19]

Kinkead

[11] Patent Number: 5,697,316

[45] Date of Patent: Dec. 16, 1997

[54] BOAT BUMPER

[76] Inventor: William Alan Kinkead, 4650 W. Rte. 6, Columbia, Mo. 65203

[21] Appl. No.: 652,807

[22] Filed: May 23, 1996

[51] Int. Cl.[6] ..... B63B 59/02

[52] U.S. Cl. ..... 114/219

[58] Field of Search ..... 114/219, 220; 405/211, 212, 215

[56] References Cited

U.S. PATENT DOCUMENTS

| | | | |
|---|---|---|---|
| 1,361,902 | 12/1920 | Porteuos | 114/219 |
| 3,000,021 | 9/1961 | Lang | 114/219 |
| 3,145,686 | 8/1964 | Blythe | 114/219 |
| 5,299,521 | 4/1994 | Loucks | 114/219 |
| 5,355,822 | 10/1994 | Lemke | 114/219 |

FOREIGN PATENT DOCUMENTS

| | | | |
|---|---|---|---|
| 525017 | 8/1940 | United Kingdom | 114/219 |

*Primary Examiner*—Stephen Avila

*Attorney, Agent, or Firm*—Kokjer, Kircher, Bowman & Johnson

[57] ABSTRACT

A boat bumper for protecting a boat from damage upon impacting a mooring or the like is disclosed. The bumper comprises a plate extending over a portion of the hull of the boat. Padding is positioned on the plate for separating the plate from the hull of the boat. The plate is connected to the boat so as to be displaceable with respect to the boat during an impact, and yet not be removed therefrom. A pair of suction cups connect the plate to the boat, the stem of the first suction cup riding in an elongate slot in the plate, and the second connected to the plate via a resilient cord.

30 Claims, 2 Drawing Sheets

BOAT BUMPER

FIELD OF THE INVENTION

The present invention relates to a boat bumper. More particularly, the invention is a bumper for connection to the outer surface of a boat, the bumper being partially displaceable with respect to the boat.

BACKGROUND OF THE INVENTION

A boat is subject to damage by a dock or similar item when moored. Wind and waves have the tendency of moving the boat with respect to its mooring, whether the mooring is a stationary dock or a floating buoy. Relative movement of the boat with respect to its mooring often causes the boat to hit the mooring, sometimes damaging the boat.

For example, a boat may be moored to a dock comprising a platform extending between posts extending out of the water. The boat is moored to the dock by pulling it alongside the dock and then tieing it to one or more of the posts.

If the boat is not moored tightly, it will move laterally with respect to the dock. The boat may drift away from the dock for some distance before being driven inwardly against the dock. The impact of the boat against the dock may damage the side of the boat.

Even if the boat is moored tightly, this usually does not prevent vertical movement of the boat. Thus, rising water as a result of a wave may push the boat upwardly along the posts. In the instance where the deck platform or other portion of the mooring extends over the boat, the boat may be driven upwardly into the mooring, damaging a top surface of the boat.

Several devices are currently utilized in an effort to prevent damage occurring when a boat hits or bounces against a mooring. The most common device employed is large cylindrically shaped styrofoam pad. The pad is tied at one end to the boat and allowed to hang downwardly along the side of the boat. The boater attempts to place the pad alongside the boat between the boat and the dock, the intent being for the pad to separate the boat from the dock and to cushion the impact of the boat against the dock.

Unfortunately, these pads are difficult to use and not tremendously effective. First, because the pads are only secured at one end to the boat they swing or sway away from the boat. This makes it difficult for the boater to align the pad, or keep it in the desired location while it is being used.

Further, the shape of these pads make them difficult to use in protecting the top of the boat. As detailed above, the top of a boat may hit the mooring. In order to protect the boat with a pad, the pad must be positioned along a top surface of the boat. This is difficult with the type of pad described above, since the pad is round and tends to roll off of the boat and because it is not designed to be secured at both ends.

A boat bumper which protects the sides and top of a boat and which is secure with respect to the boat is needed.

SUMMARY OF THE INVENTION

The present invention is a boat bumper for use in protecting a boat from damage when hitting a mooring or other item. The boat bumper extends over a portion of the hull of the boat, protecting it from damage.

The boat bumper comprises a plate for positioning over a portion of the top surface of the hull of the boat, as well as a portion of the side of the hull of the boat. Padding is connected to the plate for spacing the plate away from the hull of the boat. The padding comprises styrofoam elements for absorbing impact energy transferred through the plate.

Means are provided for mounting the plate with respect to the boat. The mounting means allows the plate to be moved with respect to the boat in an impact. Preferably, the mounting means comprises a pair of suction cups, one connected to the top end and one to the bottom end of the plate.

The suction cup at the top end of the plate attaches the bumper to the top of the boat. This suction cup has a stem which rides in a slot in the plate, allowing the plate to move with respect to the stationary suction cup.

The suction cup at the bottom end of the plate is connected to a resilient cord having a ball at the other end. The ball seats in an aperture in the plate. The suction cup is connected to the hull of the boat below the plate.

The plate of the bumper of the present invention prevents the surface of the boat from impacting a mooring or the like. The pads absorb the impact energy and spaces the plate from the boat. On impact, the plate moves with respect to the boat without being removed from the boat.

Further objects, features, and advantages of the present invention over the prior art will become apparent from the detailed description of the drawings which follows, when considered with the attached figures.

DETAILED DESCRIPTION OF THE PREFERRED EMBODIMENT

Figures 1, 2, 3:
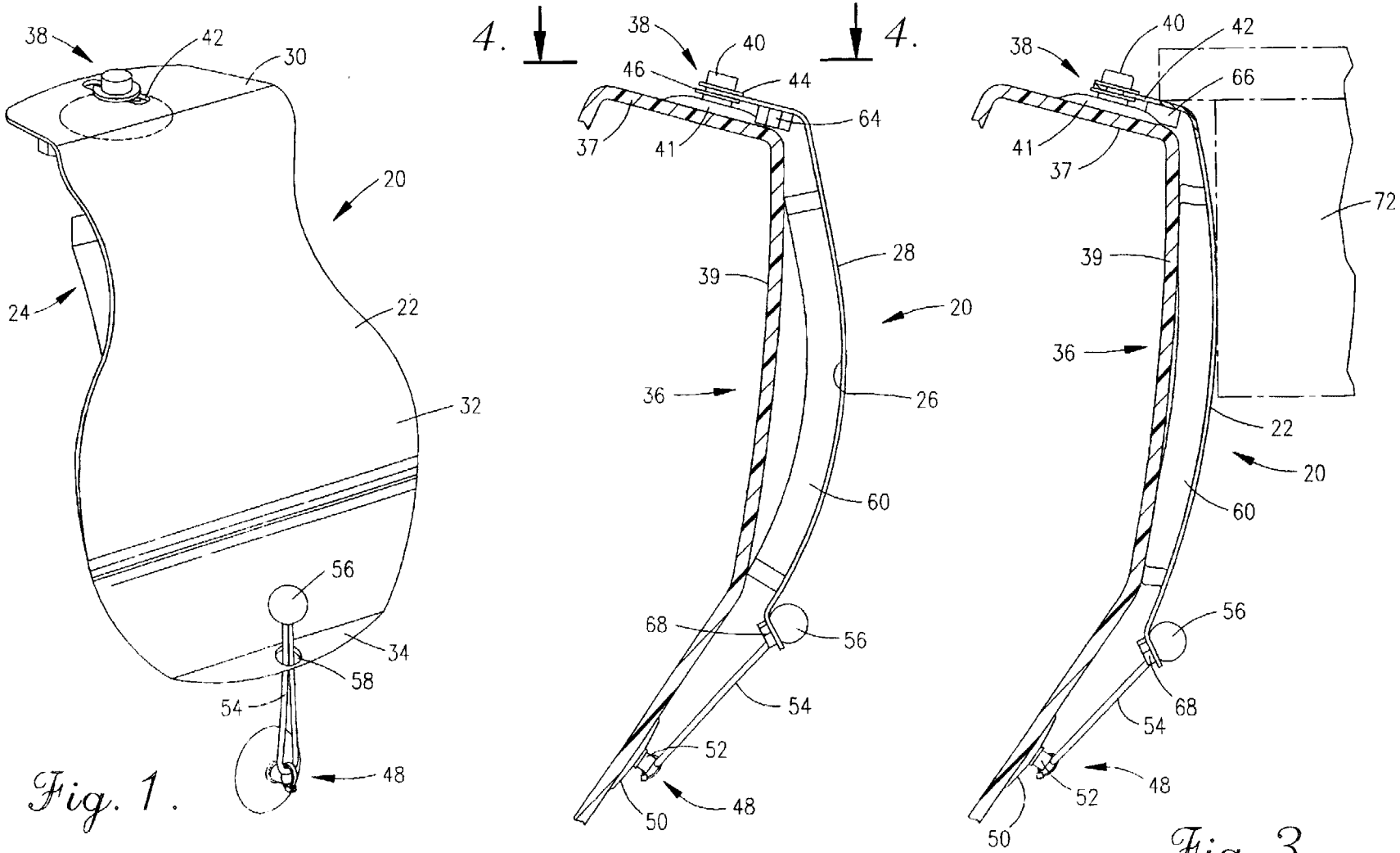
FIG. 1 is a front perspective view of a boat bumper in accordance with the present invention.
FIG. 2 is a side view of the boat bumper of FIG. 1 mounted on a boat.
FIG. 3 is a side view (shown in partial cross-section) of the boat bumper of FIG. 2 upon impact with a boat mooring.

FIG. 1 illustrates a boat bumper 20 in accordance with the present invention. The bumper 20 is useful in protecting a boat from damage when impacting a mooring or the like. The bumper 20 is designed for use with a boat having a hull 36 with a top surface 37 and a side 39.

In general, the bumper 20 comprises a bumper plate 22 for extension over a portion of the top surface 37 and side 39 of the hull 36 of the boat. Padding 24 is connected to the plate 22 for separating the plate from the boat. Means are provided for movably mounting the plate 22 to the boat.

A boater connects the bumper 20 to the outside surface of a boat. The padding 24 engages the boat, the plate 22 spaced outwardly from the boat. The plate 22 protects the boat from contacting a mooring or the like, with the padding 24 absorbing the impact. The mounting of the bumper 20 to the boat allows the bumper 20 to move with respect to the boat upon impact so that the impact does not detach the bumper 20 from the boat.

Figure 4:
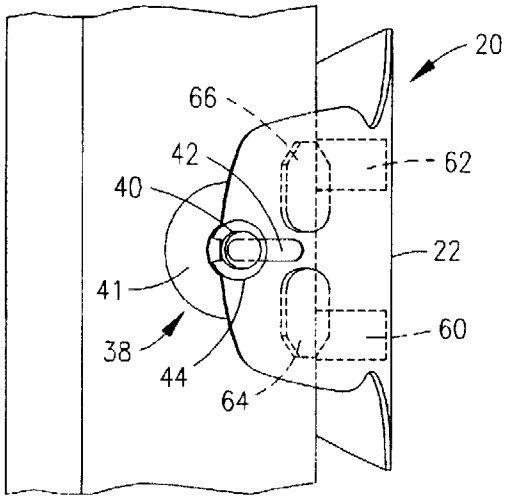
FIG. 4 is a top view of the boat bumper of FIG. 2 taken along line 4—4 therein.

Referring now to FIGS. 1, 2 and 4, the plate 22 has a first side 26 and second side 28. The plate 22 has a top section 30, middle section 32, and lower flange 34.

The top section 30 extends inwardly (towards the boat when mounted) from a top end of the middle section 32. The top section 30 is preferably about 2–4 inches long, and about 5–7 inches wide.

The middle section 32 extends downwardly from the top section 30 to the flange 34. As can best be seen in FIG. 2, the middle section 32 is preferably bowed outwardly (away from the boat when mounted) in the center. The middle section 32 has approximately the same width as the top section 30 where it meets the top section and then has a reduced section of about 5.5 inches in width before widening to a maximum width of about 10 inches. The middle section 32 is preferably about 15 inches long.

The flange 34 extends outwardly (away from the boat when the bumper is mounted) of the middle section 32. The flange 34 is wedge-shaped, extending from the middle section 32 a distance of about 1 inch at its farthest point.

The plate 22 is preferably constructed of a durable, somewhat flexible material such as ABS plastic. The plate 22 is preferably about 0.125 inches in thickness when constructed from plastic.

Means are provided for movably or displaceably mounting the plate 22 to the hull 36 of a boat. Preferably, the means includes at least one connecting element, the element connected to the plate 22 and designed for connection to the hull 36 of the boat, the plate 22 being displaceable in one or more directions with respect to the element.

In the preferred embodiment, the means for mounting includes a first suction cup 38. The first suction cup 38 has a stem 40 connected to a gripping cup 41. As best seen in FIGS. 1 and 4, the stem 40 of the first suction cup 38 is preferably mounted in a slot 42 in the top section 30 of the plate 22.

The slot 42 preferably has a width only slightly greater than the outer diameter of stem 40. The slot 42 is preferably 2–5, and more preferably about 3 times as long as the diameter of the stem 40. The slot 42 is centrally located in the top section 30 of the plate 22. The slot 42 extends generally lengthwise in the top section 30 so as to allow inward and outward movement of the plate with respect to the boat, as described in more detail below.

The stem 40 of the first suction cup 38 extends through the slot 42. To keep the first suction cup 38 connected to the plate 22, a pair of washers 44,46 are mounted on the stem 40. One washer 44 is positioned on the stem 40 on the second side 28 of the plate, and the other washer 46 is positioned on the stem 40 on the first side 26 of the plate. The washers 44,46 each have an outer dimension greater than the width of the slot 42, preventing their passage therethrough. The washers 44,46 are mounted on the stem 40 of the first suction cup 38 so that the stem can move along the slot 42, but not be pulled completely out of the slot.

The first suction cup 38 is preferably constructed of rubber or resilient plastic. The cup 41 portion of the first suction cup 38 is useful in forming a seal with the hull 36 of the boat, the cup effective in fastening the first suction cup 38, and thus the top section 30 of the plate 22, to the boat.

Preferably, the means for mounting also includes a second suction cup 48. Like the first suction cup 38, the second suction cup 48 has a cup 50 portion and a stem 52.

A cord 54 has a first end connected to the stem 52 of the second suction cup 48. A second end of the cord 54 is connected to a ball 56. The cord 54 preferably is a resilient member, such as an elastic cord.

The cord 54 extends through an aperture 58 in the flange 34. Preferably, the aperture 58 is circular in shape, having a diameter of about 0.75 inches. The ball 56 is preferably spherical in shape, having a diameter greater than the diameter of the aperture 58.

The second suction cup 48, connected to the ball 56 via the cord 54, is used to connect the bottom portion of the plate 22 to the hull 36 of the boat, as described in more detail below.

Figure 5:
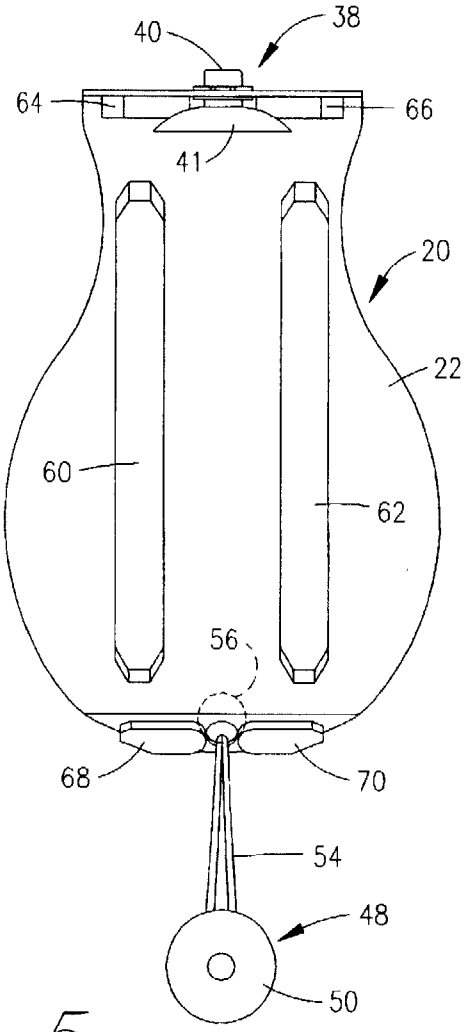
FIG. 5 is a front view of the boat bumper of FIG. 1.

As best illustrated, in FIG. 5, padding 24 is positioned on the first side 26 of the plate 22. Preferably, two elongate pads 60,62 are connected to the first side 26 of the plate 22 in the middle section 32. The pads 60,62 are about 1.25 inches wide, 1 inch thick, and 11–12 inches long.

Smaller pads 64,66 are connected to the first side 26 of the plate 22 at the top section 30. These pads 64,66 are preferably about 1 inch long, 2.5–3 inches wide, and 0.5 inches thick.

Similar pads 68,70 are connected to the first side 26 of the plate 22 at the flange 34. These pads 68,70 are about 1 inch long, 2 inches wide, and 0.25 inches in thickness.

All of the pads 60–70 are preferably constructed of material which provides an energy absorbing feature, which is durable and which is not affected by water. One material which from which the pads 60–70 may be constructed is closed cell foam. The pads 60–70 are connected to the plate 22 with glue or the like.

Use of the bumper 20 of the present invention is as follows. A boater attaches the cup 41 of the first suction cup 38 to the hull 36 of the boat. The first suction cup 38 is connected to the top surface 37 of the hull 36 adjacent the downwardly extending outer side 39 of the hull.

The boater then pulls on the second suction cup 48, extending it downwardly from the flange 34. The boater's pulling on the second suction cup 48 causes the ball 56 to seat in the aperture 58. The boater connects the cup 50 of the second suction cup 48 to the hull 36 of the boat.

When the bumper 20 is connected, the pads 60–70 engage the hull 36 of the boat, as illustrated in FIG. 2. The downward force applied by the boater to the cord 54 causes the plate 22 to slide down until it hits the stem 40 of the first suction cup 38 at the top end of the slot 42, as illustrated in FIG. 4.

Importantly, the bumper 20 protects both the top and side of the hull of the boat, as illustrated in FIG. 3. If the boat moves laterally towards a mooring 72, the side of the boat is protected by the bumper 20. The plate 22 hits the mooring 72 instead of the hull 36 of the boat. The impact of the boat causes the plate 22 to flex inwardly towards the boat, the padding 24 acts as a cushion and absorbs part of the impact energy, as best illustrated in FIG. 3.

If the boat rises upwardly, the top surface 37 of the hull 36 of the boat is protected by the bumper 20. As illustrated in FIG. 3, in this situation the mooring 72 contacts the top section 30 of the plate 22. Here the pads 64,66 serve to prevent the plate 22 from contacting the boat and absorb part of the energy of the impact.

Most importantly, the bumper 20 remains connected to the boat when it impacts the mooring 72. As stated above, when the boat impacts the mooring 72 when moving laterally, the plate 22 moves inwardly towards the boat. When this occurs, the plate 22 moves with respect to the stem 40 of the first suction cup 38 as permitted by the slot 42. Because the plate 22 can move relative to the boat connection, the connector (suction cup) is not dislodged and the bumper 20 remains connected to the boat.

The opposite end of the bumper 20 can also move with respect to the boat connection. For example, if the plate 22 is forced downwardly or inwardly, the cord 54 changes length, maintaining the connection between the second suction cup 48 and the plate 22. When this occurs, the second suction cup 48 does not move, remaining in contact with the boat and keeping the bumper 20 on the boat.

In order to fully protect a boat, it may be desirable to connect several bumpers 20 at various locations along the sides and/or rear of the boat.

While the plate 22 has been described as having one particular shape in conjunction with the preferred embodiment described above, other shapes are contemplated. Further, the size of the plate 22 may be changed as necessary to protect a given boat. For example, for a bass boat, which does not extend very far above the waterline, a bumper 20 having the dimensions listed above may be used. If the bumper is to be used to protect the hull of a cabin cruiser, however, it may need to be much longer.

Figure 6:
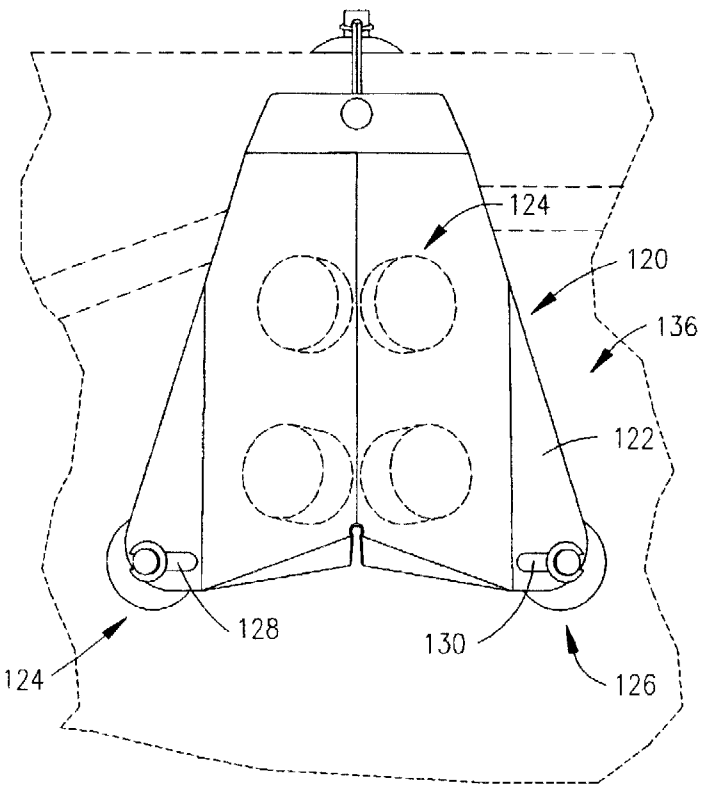
FIG. 6 is a front view of an alternate embodiment boat bumper in accordance with the present invention.

FIG. 6 illustrates an alternate embodiment bumper 120 of the present invention. This bumper 120 has a plate 122 which is generally trapezoidal in shape. This particular plate 122 is configured to protect generally only the side of the hull 136 of the boat, and not the top as well. This design is particularly useful for taller boats where the risk of damage to the top portion of the boat is remote, but the risk of damage to the sides is high.

It may be desirable to displaceably mount the bumper 20 in other ways than that described above. For example, it may be desirable to allow the boat mounting to move in more than one direction with respect to the plate 22 of the bumper. Here, the stem of the suction cup might be mounted for travel in several connecting slots which extend in different directions.

FIG. 6 illustrates such an embodiment. In this form of the invention, a pair of suction cups are mounted in "L"-shaped slots in the plate 122. As illustrated, the slots are designed to allow the plate 122 to move with respect to the bumper 120 mounting in either the vertical or horizontal direction.

Instead of slots, the stem of the suction cup or other mounting device may be located in an aperture of a different configuration. For example, the aperture may be circular in shape. In this instance, the stem of the suction cup extends through the aperture, and washers which have an outer diameter greater than the diameter of the aperture are utilized to maintain the stem connected to the plate. When the stem is mounted in a circular aperture in the plate, the plate may move with respect to the stem in any direction.

Further, mounting elements other than suction cups may be utilized. For example, it is possible to permanently attach stems or posts to the hull of the boat to or on which the plate is mounted. For example, such a post may extend through a slot in the plate similar to a stem of a suction cup. Alternatively, the post may be spaced from the plate and connected with a resilient cord as described above.

As illustrated in FIG. 6, the padding 24 may take other forms and shapes. In FIG. 6, the padding 124 comprises circular discs of material positioned generally in the center of the plate 122. Further, the padding might be replaced with other resilient means, such as small springs located in a rubber housing mounted on the plate.

Alternatively, it may not be necessary to include separate padding elements. For example, in cases where the plate is mounted with suction cups, such may provide the bumper with desired energy absorbing capacity. Also, the plate may be constructed of another material, such as a rigid outer shell containing a foam or other energy absorbing material. Lastly, it is possible to simply mount the plate against the boat with the plate having little or no energy absorbing capacity. This has the disadvantage, however, of the bumper not protecting the boat against impact as well as the preferred embodiment. Such a bumper does protect the boat against scrapes and scratches.

The bowing of the plate 22 is useful in absorbing some of the impact of the boat. As also illustrated in FIG. 6, the plate 122 may be creased, causing the plate 122 to have a spring-like nature as well.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A boat bumper for protecting a boat from damage by a mooring, said boat having a hull with a top and a side, said boat bumper comprising:

a protective plate for positioning over a surface of the boat to be protected, said protective plate being semi-rigid;

padding connected to said plate for spacing said plate from said surface of said boat; and means for movably mounting said plate to said boat, wherein said plate remains movable with respect to said boat during use.

2. The boat bumper of claim 1, wherein said plate has a first section for extension over a portion of said top of said hull and a second section for extension over a portion of said side of said hull, wherein said second section bows outwardly with respect to said boat when mounted on said boat.

3. The boat bumper of claim 2, wherein said second section has a top end and a botton end, said first section extending from said top end of said second section and further including a flange extending from said bottom end of said second section.

4. The boat bumper of claim 3, wherein said means for movably connecting comprises a first element connected to said first section and a second element connected to said flange.

5. The boat bumper of claim 4, wherein said first element comprises a first suction cup and said second element comprises a second suction cup.

6. The boat bumper of claim 5, wherein said first suction cup has a stem positioned within a slot in said plate.

7. The boat bumper of claim 5, wherein said second suction cup is connected to said plate with a cord.

8. The boat bumper of claim 7, further including a ball connected to said cord, said ball engaging an aperture in said flange of said plate.

9. The boat bumper of claim 1, wherein said padding comprises closed cell foam.

10. The boat bumper of claim 1, wherein said means for movably mounting comprises at least one element for connection to said boat and slidable connection to said plate.

11. The boat bumper of claim 1, wherein said means for movably mounting includes at least one suction cup.

12. The boat bumper of claim 11, where said suction cup has a stem and a cup and further including a slot in said plate, said stem of said suction cup extending through said slot thereby defining a slidable engagement.

13. The boat bumper of claim 12, further including at least one washer for retaining said suction cup to said plate.

14. The boat bumper of claim 11, further including a cord connecting said suction cup to said plate.

15. The boat bumper of claim 14, wherein said plate has an aperture therethrough, and further including a ball connected to said cord for seating in said aperture.

16. In combination, a boat and a device for protecting the boat from damage, said boat having a hull with a top and a side, and said device comprising a semi-rigid plate having a bow therein, the plate for positioning over at least a portion of said hull and mounting means for movably and slideably mounting said plate to said boat and wherein said plate is movable by deformation relative to said mounting means and said boat.

17. The combination of claim 16, wherein said plate has a first section for location over at least a portion of said top of said hull and a second section for location over at least a portion of said side of said hull, and the bow of the plate is curved and outward with respect to the boat when the plate is mounted on the boat.

18. The combination of claim 16, wherein said means for movably and slideably mounting comprises at least one suction cup.

19. The combination of claim 18, wherein said suction cup has a stem and a cup, and further including slot in said plate, said stem slideably engaging said slot.

20. The combination of claim 19, further including at least one washer connected to said stem for retaining said stem in said slot.

21. The combination of claim 16, further including a cord having a first end and a second end, said first end connected to said such cup and said second end connected to said plate.

22. The combination of claim 21, further including an aperture in said plate and a ball connected to said second end of said cord, said ball for seating in said aperture.

23. The combination of claim 16, wherein said device includes padding.

24. The combination of claim 23, wherein said padding comprises closed cell foam elements mounted on said plate.

25. A boat bumper for protecting a top and a side of a hull of a boat, comprising:

a protective plate, said plate being semi-rigid and resilient, said plate further being bowed outwardly with respect to said side of said hull of said boat when mounted on said boat; and a mounting member for mounting said plate to said boat, wherein said plate is movably attached to said mounting member such that said plate is movable with respect to said mounting member during use.

26. The boat bumper of claim 25, wherein said mounting member is releasably mounted to said boat such that said mounting member may be positioned at various locations on said boat.

27. The boat bumper of claim 25, wherein said mounting member has a stem and said plate has a slot for slidably receiving said stem of said mounting member.

28. The boat bumper of claim 25, wherein said mounting member is a suction cup.

29. A boat bumper for protecting a boat, the bumper comprising:

a mounting member attachable to the boat; and a semi-rigid and elastically deformable protective plate attached to the mounting member with the plate being movable relative to the mounting member by deformation and the plate further being bowed relative to the boat when mounted on the boat.

30. The bumper of claim 29, wherein the bow of the plate is curved and outward relative to the boat when mounted on the boat.

* * * * *